US011008725B2

(12) United States Patent
Thurner et al.

(10) Patent No.: US 11,008,725 B2
(45) Date of Patent: May 18, 2021

(54) DRIVING DEVICE WITH IMPACT EFFECT

(71) Applicant: Krinner Innovation GmbH, Strasskirchen (DE)

(72) Inventors: Günther Thurner, Strasskirchen (DE); Martin Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 76 days.

(21) Appl. No.: 16/426,231

(22) Filed: May 30, 2019

(65) Prior Publication Data

US 2019/0382977 A1 Dec. 19, 2019

(30) Foreign Application Priority Data

Jun. 20, 2018 (DE) ..... 10 2018 209 564.7

(51) Int. Cl.

| | |
|---|---|
| ***E02D 5/56*** | (2006.01) |
| ***E02D 7/06*** | (2006.01) |
| ***E02D 7/26*** | (2006.01) |
| ***E02D 7/22*** | (2006.01) |

(52) U.S. Cl.

CPC ..... *E02D 7/26* (2013.01); *E02D 5/56* (2013.01); *E02D 7/06* (2013.01); *E02D 7/22* (2013.01)

(58) Field of Classification Search

CPC .... E02D 7/06; E02D 7/22; E02D 7/26; E02D 5/56

See application file for complete search history.

(56) References Cited

U.S. PATENT DOCUMENTS

| | | | | | |
|---|---|---|---|---|---|
| 3,404,740 | A | * | 10/1968 | Hoppe | E02D 3/106 173/111 |
| 3,777,825 | A | * | 12/1973 | Gullich | B25D 16/00 173/13 |
| 4,061,197 | A | * | 12/1977 | Skidmore, Jr. | E21B 4/14 175/101 |
| 4,147,457 | A | * | 4/1979 | Washida | E02D 7/26 254/29 R |
| 4,468,594 | A | * | 8/1984 | Jacquemet | E02D 7/06 318/130 |
| 4,494,613 | A | * | 1/1985 | Tamaki | E02D 7/20 173/105 |

(Continued)

FOREIGN PATENT DOCUMENTS

| | | |
|---|---|---|
| AT | 315053 B | 5/1974 |
| WO | WO-2015128048 A1 | 9/2015 |
| WO | WO-2016139523 A1 | 9/2016 |

*Primary Examiner* — Benjamin F Fiorello

(74) *Attorney, Agent, or Firm* — Marshall, Gerstein & Borun LLP

(57) ABSTRACT

The invention relates to a driving device, in particular a screw foundation driving device, having an anchor with a rotational axis for receiving a driving tool, an outer rotor, which is arranged concentrically to the rotational axis of the anchor and can be rotationally driven by a motor, and an impact device from which an impact energy can be introduced into the anchor. By means of rolling bodies arranged circumferentially on the anchor, the anchor is mounted in the outer rotor in such a way that a relative movement between the anchor and the outer rotor can be executed in the direction of the rotational axis and a torque about the rotational axis can be introduced from the outer rotor to the anchor via the rolling bearings.

15 Claims, 6 Drawing Sheets

(56) References Cited

U.S. PATENT DOCUMENTS

| | | | | |
|---|---|---|---|---|
| 5,010,965 | A * | 4/1991 | Schmelzer | E21B 47/0232 175/19 |
| 5,027,908 | A * | 7/1991 | Roussy | E02D 7/26 173/49 |
| 5,980,162 | A * | 11/1999 | McCown | E02D 5/56 405/244 |
| 9,039,330 | B1 * | 5/2015 | Olson | E03F 3/06 405/184.5 |
| 9,328,560 | B2 * | 5/2016 | Puttmann | E21B 17/03 |
| 9,995,087 | B2 * | 6/2018 | Queen | E21B 7/005 |
| 2003/0221870 | A1 * | 12/2003 | Johnson, Jr. | E21B 15/003 175/71 |
| 2016/0362864 | A1 * | 12/2016 | Thurner | E02D 5/60 |
| 2018/0155893 | A1 * | 6/2018 | Fuller | E02D 7/00 |
| 2018/0274298 | A1 * | 9/2018 | McMillan | E21B 6/06 |

* cited by examiner

DRIVING DEVICE WITH IMPACT EFFECT

CROSS-REFERENCE TO RELATED APPLICATION

Priority is claimed to German Patent Application DE 10 2018 209 564.7, filed on Jun. 14, 2018, the entire contents of which are incorporated herein by reference.

FIELD OF THE DISCLOSURE

The invention relates to a driving device, in particular a screw foundation driving device.

BACKGROUND

Driving devices, in particular screw foundation driving devices, are known from the prior art. WO 2015 128 048 A1 discloses a device for inserting screw foundations into the ground. The device comprises a turning device for screwing in the screw foundation and an impact device for generating an impact force in the insertion direction of the screw foundation. For transmitting torques, the drive shaft has vanes with contact-surface pairs, via which contact-surface pairs the torque of the motor is transmitted to the drive shaft. In this case, the contact-surface pairs are formed in such a way that, upon the impact, they permit a relative movement between the hollow shaft and drive shaft in the direction of the insertion direction. In this case, the contact-surface pairs are arranged on a diameter which is considerably greater than the diameter of the two shafts, i.e. the motor shaft and the drive shaft. If the mechanical load on the friction-surface pairs is to be reduced, it is proposed to increase the diameter on which the contact-surface pairs are arranged, in particular to 5 times the diameter of the drive shaft.

GENERAL DESCRIPTION

This manner of torque transmission is disadvantageous in that friction arises between the contact-surface pairs, in particular upon a simultaneous introduction of the impact in the longitudinal direction and the torque in the circumferential direction, which friction destroys the surface of the contact-surface pairs over time.

The object of the present invention is therefore to provide a driving device which is improved over the prior art and which is, in particular, insensitive to wear.

The driving device according to the invention is, in particular, a screw foundation driving device. The driving device comprises an anchor with a rotational axis for receiving a driving tool. The driving device further comprises an outer rotor, which is arranged concentrically to the rotational axis of the anchor and can be rotationally driven by a motor. The driving device has an impact device from which an impact energy can be introduced into the anchor. By means of rolling bodies arranged circumferentially on the anchor, the anchor is mounted in the outer rotor in such a way that a relative movement between the anchor and the outer rotor can be executed in the direction of the rotational axis and a torque about the rotational axis can be introduced from the outer rotor to the anchor. The torque can be transmitted via the rolling bodies.

The rolling bodies are preferably arranged in grooves, in particular a plurality of grooves both in the outer rotor and in the anchor. A plurality of grooves which extend parallel to one another can be arranged in the anchor. For example, 16 or 24 grooves can be arranged on the circumference of the anchor. In this case, the grooves are preferably distributed on the circumference at regular spacings. In this case, the grooves are incorporated in an outer surface of the anchor. Corresponding grooves in the outer rotor are arranged on an inner surface of the outer rotor. In this case, the grooves in the outer rotor correspond in number, and possibly in terms of their length, to the grooves in the anchor.

There can be one or more rolling bodies in each of the grooves. When there are several rolling bodies, these are separated from one another by intermediate elements, for example rolling-bearing cages. The friction is thus minimised. The rolling-bearing cages are preferably solid in form so that they can transmit the impact force and have a surface corresponding to the rolling-bearing surface as a track. With a plurality of rolling bodies for each groove, i.e. at least two rolling bodies for each groove, the torque to be transmitted is increased whilst the size of the rolling bearings remains constant.

In a preferred embodiment, the rolling bodies are formed as balls. In this case, the radius or the diameter of the balls is preferably slightly smaller than the radius which defines the surface of the groove. Therefore, the balls can be slightly, i.e. generally not plastically, deformed under a load and therefore adapt to the surface of the respective groove or the ball track.

In an alternative embodiment, the rolling bodies are formed as rollers. Rollers are advantageous over balls in that they enable a higher torque to be transmitted from the outer rotor to the anchor. In this case, the rollers are formed in particular as cylindrical rollers.

So that the torque transmission takes place via the running surface of the rollers, the rollers are slanted at the angle $\alpha$ with respect to the radial direction in a plane transverse to the rotational axis. Therefore, in one turning direction, the torque can be transmitted via the running surface of the rollers. In the opposite direction, the torque is transmitted via the side walls of the rollers, although this is disadvantageous in terms of the wear. The rollers are therefore positioned such that, in the driving direction, they transmit the torque via the running surfaces.

The grooves preferably have a longitudinal direction in which the relative movement between the anchor and outer rotor takes place. In this case, the relative movement is delimited by the length of the grooves, wherein the corresponding grooves in the anchor and the outer rotor preferably have the same length. Therefore, the rolling bodies roll along the surface of the grooves, i.e. along the rolling-bearing track, over the entire length of the groove when they move from one end position at one end of the groove into the opposing end position at the other end of the groove. In this case, the longitudinal direction is preferably arranged parallel to the rotational axis of the anchor or the outer rotor. Moreover, not only the corresponding grooves, but all grooves in the anchor and in the outer rotor, preferably have the same length. The path of the relative movement between the anchor and outer rotor is determined and delimited by the length of the grooves.

Alternatively, the main direction of extent of the groove is slanted at an angle $\beta$. The groove furthermore has a main direction of extent parallel to the rotational axis; however, the groove additionally possesses another component in the circumferential direction. This slanting results in the grooves having a helical form. Such a form of the grooves leads to an increase in speed or a reduction in speed during an axial displacement between the anchor and the outer rotor. The angle $\beta$ preferably has a value in the region of a few degrees, in particular 1, 2 or up to 5 degrees. The angle β is preferably aligned in such a way that the increase in speed takes place when an impact occurs. The rotational speed is therefore increased during the impact and reduces during the subsequent rebound or return movement of the anchor. This results in an angular speed of the anchor, and therefore the driving tool, which pulsates synchronously with the impact mechanism.

For mounting and maintenance reasons, the outer rotor is preferably formed such that it is divided into parts. The division preferably takes place in a plane transverse to the rotational axis and intersects the grooves in the outer rotor. In this case, the outer rotor is subdivided into an outer rotor part and a terminating ring. In this case, the significant length of the grooves is preferably incorporated in the outer rotor part. Preferably, only a short region of the grooves in the longitudinal direction is arranged in the terminating ring. In a preferred embodiment, the terminating ring has a circumferential chamfer with a radius, which chamfer serves as a groove end and therefore as a stop for the rolling bodes. The individual grooves are therefore no longer subdivided in the terminating ring. Accordingly, the length of the grooves in the terminating ring is smaller than the radius of the rolling bodies. The radius of the circumferential chamfer preferably corresponds to the radius of the rolling body or is greater than the radius of the rolling body surface, i.e. the rolling surface. The path between the outer rotor and the anchor which is available for the relative movement is preferably delimited by the length of the grooves. In one end position, the rolling body is jammed between one end of the anchor groove and an opposing end of the outer rotor groove. The second end position is defined by the respective opposing ends of the anchor grooves and outer rotor grooves.

In a preferred embodiment, the outer rotor part is formed from steel, whereas the terminating ring is formed from aluminium. In this case, the terminating ring is preferably arranged in such a way that it serves as a stop for the balls after the introduction of the impact. The terminating ring is therefore arranged at the lower end of the outer rotor, which faces the ground or the screw tool. By using a more ductile material, such as aluminium, the balls are protected against plastic deformation or destruction, which has a positive influence on the durability of the device. Instead of aluminium, other materials which are more ductile than the rolling-body material can also be used.

The driving device preferably has a damping element between an axial shoulder in the anchor and an axial shoulder in the outer rotor. The axial shoulder has a shoulder surface which extends in the radial direction, i.e. the diameter of the anchor and outer rotor increases and decreases. Between the axial shoulder, the damping element is arranged on the outer diameter of the anchor and/or on the inner diameter of the outer rotor. The damping element is therefore capable of cushioning shocks on the outer rotor from the anchor. The damping element is preferably arranged on the anchor on a side of the bearing arrangement which is remote from the tool holder. Therefore, the damping element is capable of absorbing a rebound in the opposite direction to the impact pulse, which rebound takes place after the impact pulse has been applied to the anchor and the screw tool. The damping element is preferably dimensioned in such a way that it abuts between the axial shoulders on both sides before the rolling bodies arrive in their end position, but permits the rolling bodies, and therefore also the anchor and the outer rotor, to reach their end position relative to one another. In a preferred embodiment, the damping element is formed as an elastomer, which is arranged as a circular disc on the outer diameter of the anchor. Alternatively, the damping element can also be formed as an oil damping element or air damping element.

A seal is preferably arranged between the anchor and the outer rotor. In the region of the bearing arrangement, the anchor or the anchor shaft preferably has an increased diameter compared to the adjacent portions of the anchor. In the region of the bearing arrangement, the outer rotor is preferably formed as a rotationally symmetrical hollow body, in particular as a bowl-shaped hollow body, which is open in the direction of the tool holder. The bowl-shaped region of the outer rotor and the increased region of the anchor overlap one another so that, in the overlap region, the rolling bodies are arranged between the anchor and the outer rotor. The outer rotor preferably terminates with the bowl-shaped bearing-arrangement region in the direction of the tool holder.

To prevent or minimise the penetration of dust and dirt, in particular when using the driving device, a seal is arranged between the outer rotor and anchor on the side of the bearing arrangement which faces the workpiece. The seal is preferably formed as a radial seal, in particular as a radial shaft seal or as a labyrinth seal. The seal is preferably arranged in the terminating ring of the outer rotor.

The driving tool holder is preferably formed for receiving a screw foundation so that the screw foundation serves as a drilling tool. The driving tool holder preferably has a core which stabilises the screw foundation from the inside and receives the screw foundation in a torsion-resistant manner. In this case, the driving operation preferably takes place in series with the introduction of the impact energy or at least periodically coinciding with the introduction of the impact energy. The impact energy can also be introduced into the screw foundation without interrupting the driving procedure. After the driving operation, the screw foundation generally remains in the ground as a ground anchor. Further details relating to exemplary insertion methods or driving methods which can be implemented using a driving device according to the invention are revealed in the printed document WO 2015 128 048 A1.

According to the invention, the driving device according to the invention can apply a torque and an impact energy to a driving tool. A driving tool can also be a drilling tool, i.e. an earth auger. When driving in a screw foundation, for example, the ground is substantially compacted around the foundation. The driving operation substantially refers to displacement screwing. On the other hand, in a drilling operation, the earth is removed from the drill hole via a helix. With the device according to the invention, an (impact) drilling procedure can likewise be carried out, which means that the driving tool is a drilling tool. Both a screw foundation and also a conventional drill, in particular a masonry drill or rock drill, can be used as the drilling tool.

The driving device is preferably formed in such a way that it can be suspended on a carriage. The thrust in the direction of the rotational axis, i.e. in the driving direction, can be exerted on the driving device via the carriage. The thrust is preferably adjustable, in particular depending on the helix height of an outer helix of the screw foundation and/or the speed of the anchor. The anchor and the outer rotor are rotatably mounted on the carriage and via a support or housing respectively. The carriage is moreover displaceably mounted in the driving device. The impact device moreover has a hammer, i.e. a mass, which is likewise mounted on the carriage such that its displaceable in the driving device. The motor for rotationally driving the outer rotor is likewise fastened to the carriage. In one embodiment, the motor is formed as an electric motor or as a hydraulic motor. The carriage with the driving device therefore forms a driving system.

BRIEF DESCRIPTION OF THE DRAWINGS

The teaching according to the invention is explained in more detail below with reference to figures, which show.

DETAILED DESCRIPTION

Figure 1:
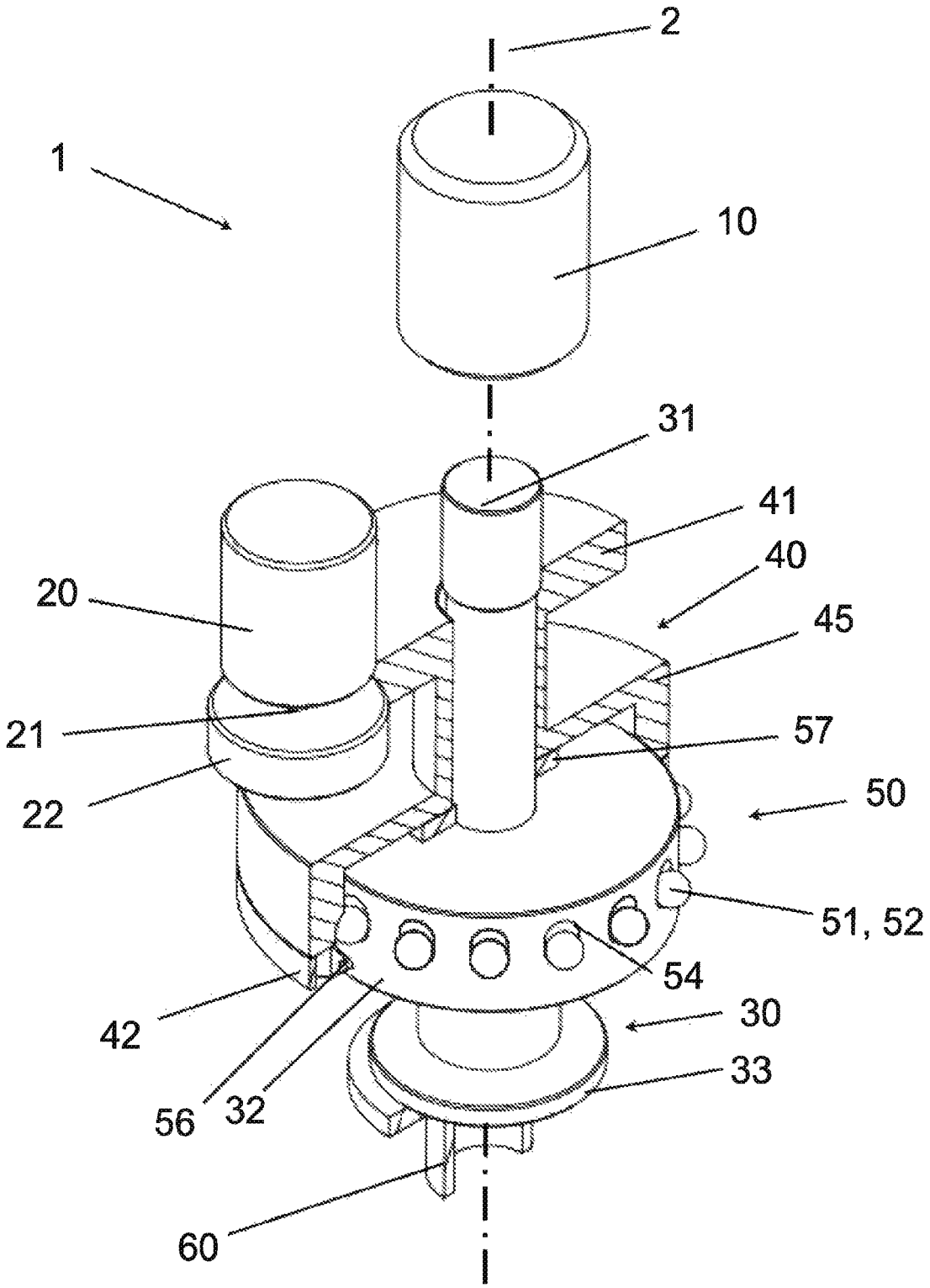
FIG. 1 a three-dimensional illustration of a driving device according to the invention FIG. 2 a sectional illustration of a driving device according to the invention FIG. 3 a sectional illustration along the plane A-A of FIG. 2

FIG. 1 shows a three-dimensional illustration of a driving device 1 according to the invention. For better visualisation of the device according to the invention, an outer rotor 40 is illustrated in section so that a bearing arrangement 50 according to the invention is shown. A driving device 1 according to the invention comprises an impact device, which is illustrated as a hammer 10 here. Impact energy can be introduced into an anchor 30 via the hammer 10. In this case, the hammer 10 strikes a head 31 of the anchor 30. The anchor 30 is formed as a shaft with varying diameters. The anchor is shown as a single-piece component here, wherein a multi-part form is also covered by the teaching according to the invention. The outer rotor 40 is arranged concentrically to the anchor 30. During operation, the outer rotor 40 can be rotationally driven by a motor 20. The driving device 1 has a longitudinal axis 2, which also serves as a turning or rotational axis for the anchor 30 and the outer rotor 40.

The motor 20 has an output shaft 21 on which a spur wheel 22 is arranged. A drive wheel 41 of the outer rotor 40 can be driven by the spur wheel 22. In the present exemplary embodiment, the outer rotor 40 is formed in a drum shape. It has a greater diameter in the region of the drive wheel 41, which merges into an adjoining smaller outer diameter whilst the inner diameter remains constant. In the figure, there is an adjoining bowl-shaped region towards the bottom, in which both the inner and the outer diameter are increased. Installation space for the bearing arrangement 50 is thus created, via which bearing arrangement the anchor 30 is mounted in the outer rotor 50. The outer rotor 40 moreover has a terminating ring 42 at the end, which is formed as a separate component and is screwed to the rotor component 45.

The anchor has a region with an increased outer diameter, which is referred to as a plate 32 here. The bearing arrangement 50 is arranged in the region of the plate 32. To this end, the plate 32 has anchor grooves 54 arranged on the outer circumference. The anchor grooves 54 are arranged at regular spacings on the circumference of the anchor 30. The anchor grooves 54 extend in the longitudinal direction of the anchor 30 and parallel to the longitudinal axis 2 or rotational axis. They have a substantially partially circular cross-section and are likewise rounded at their ends. A ball 52 is arranged in each anchor groove 54 as a rolling body 51.

A corresponding number of rotor grooves 55 is arranged in the outer rotor 40. In this case, the rotor grooves 55 extend in the longitudinal direction of the rotor 40 and, with this, are arranged at regular spacings on an inner surface of the outer rotor 40 in the bowl-shaped region.

The anchor grooves 54 and the rotor grooves 55 serve as a running surface for the balls 52. In one embodiment, a ball 52 is arranged in each groove pair consisting of an anchor groove 54 and a rotor groove 55. The anchor grooves 54 and the rotor grooves 55 generally have the same length. The relative movement between the anchor 30 and the outer rotor 40 in the direction of the longitudinal axis 2 is thus delimited. For mounting reasons and for maintenance reasons, the outer rotor 40 has the terminating ring 42 at its lower end, or its end facing the tool holder 33. The rotor grooves 55 extend from the rotor component 45 into the terminating ring 42. Therefore, the bearing running surfaces on the rotor side also extend over the rotor component 45 and the terminating ring 42. In the embodiment shown in FIG. 1, the grooves in the terminating ring 42 do not have a lateral delimitation. Instead, the terminating ring has a chamfer with a radius which delimit the rotor grooves 55 in the longitudinal direction and serve as a stop for the balls 52. Such a form can be produced in a simple manner. However, it must be ensured that the terminating ring 42 and the chamfer 43 are dimensioned in such a way that the individual balls cannot exit the corresponding rotor groove 55 in the mounted state of the bearing arrangement 50.

Via the bearing arrangement 50 described above, torques can be transmitted from the motor 20 to the anchor 30 in both directions of rotation via the outer rotor 40. The anchor 30 has a holder 33 for a drilling tool. A screw foundation 60 is shown in section and in part here as the drilling tool. The holder 33 is arranged on the end of the anchor 30 which is opposite the anchor head 31. A torque or a turning movement can thus be transmitted by the motor to the screw foundation 60 so that this can be driven into the ground or removed from the ground.

At the same time, the bearing arrangement 50 enables impact energy from the hammer 10 to be introduced into the anchor 30 and therefore, via the holder 33, into the screw foundation 60. The impact stroke is delimited by the bearing arrangement 50. If impact energy is introduced into the screw foundation 60, the energy is fed back in the opposite direction depending on the ground conditions. The screw foundation 60 practically bounces off hard grounds and results in a rebound. To cushion the rebound, a resilient damping element 57 is arranged in the driving device 1. The damping element 57 is formed as an elastomer and arranged concentrically to the longitudinal axis 2 between the plate 32 and a shoulder in the rotor component 45 on a side which faces the impact device 10 or is remote from the tool holder 33.

A radial seal 56 is arranged on the terminating ring 42. The radial seal 56 forms a seal with respect to the plate 32 of the anchor 30 so that dust is prevented from penetrating into the bearing arrangement 50.

Figure 2:
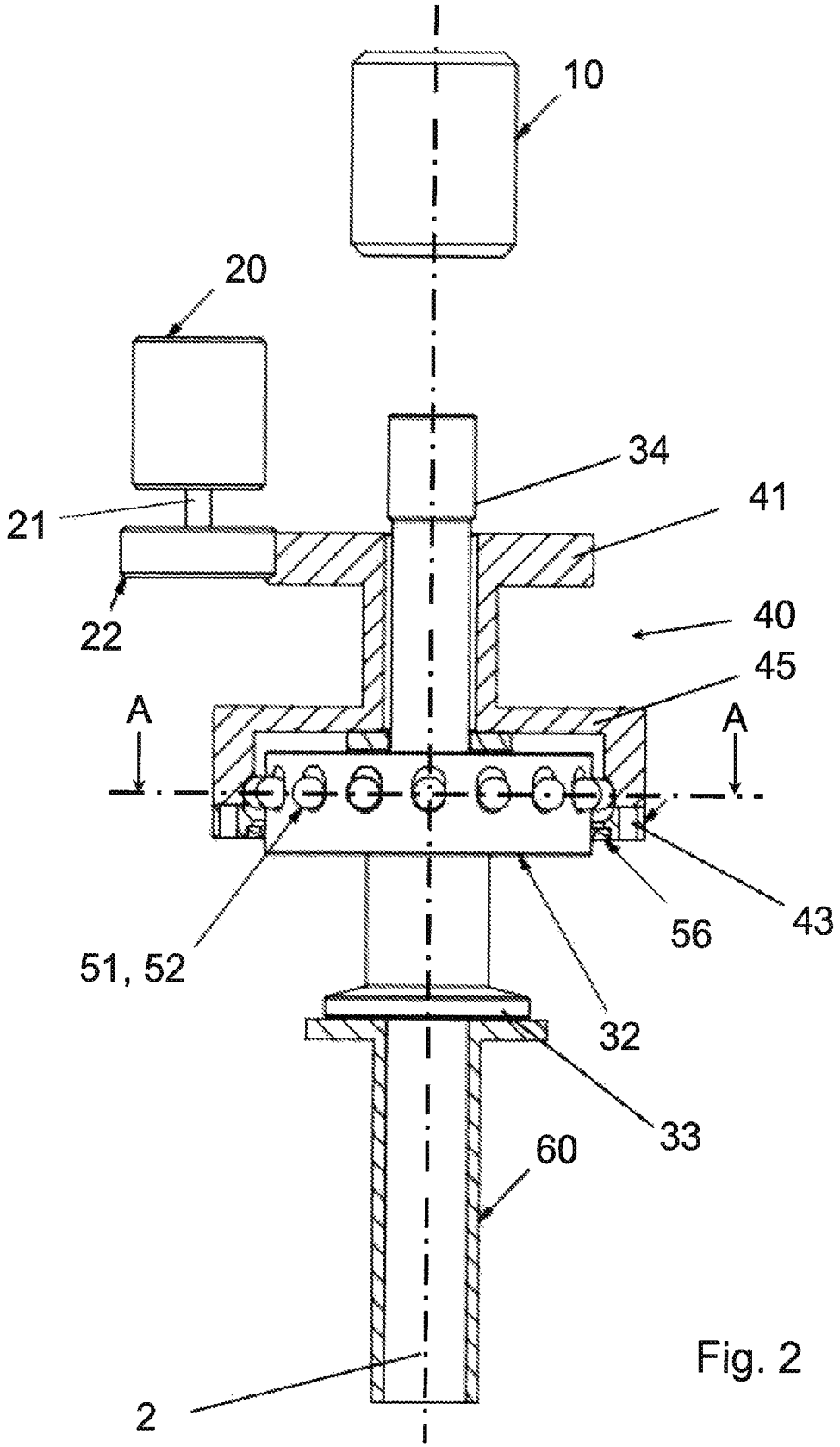
Figure 3:
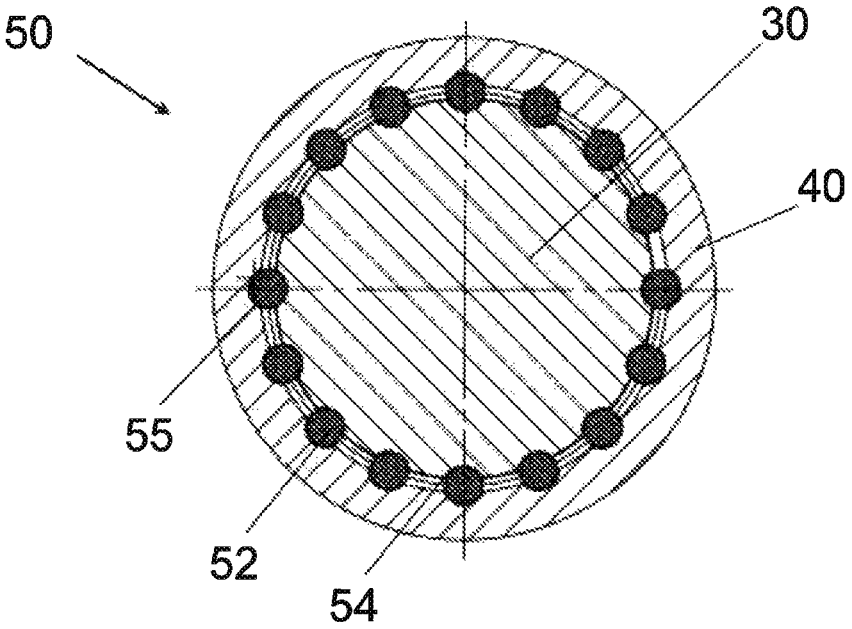

FIG. 3 shows a section along the plane A-A of FIG. 2. In the bearing arrangement 50, 16 bearing balls 52 are arranged regularly on the outer circumference of the anchor 30 and on the inner circumference of the outer rotor 40. The balls 52 are arranged in corresponding anchor grooves 54 and rotor grooves 55, which serve as tracks.

Figure 4:
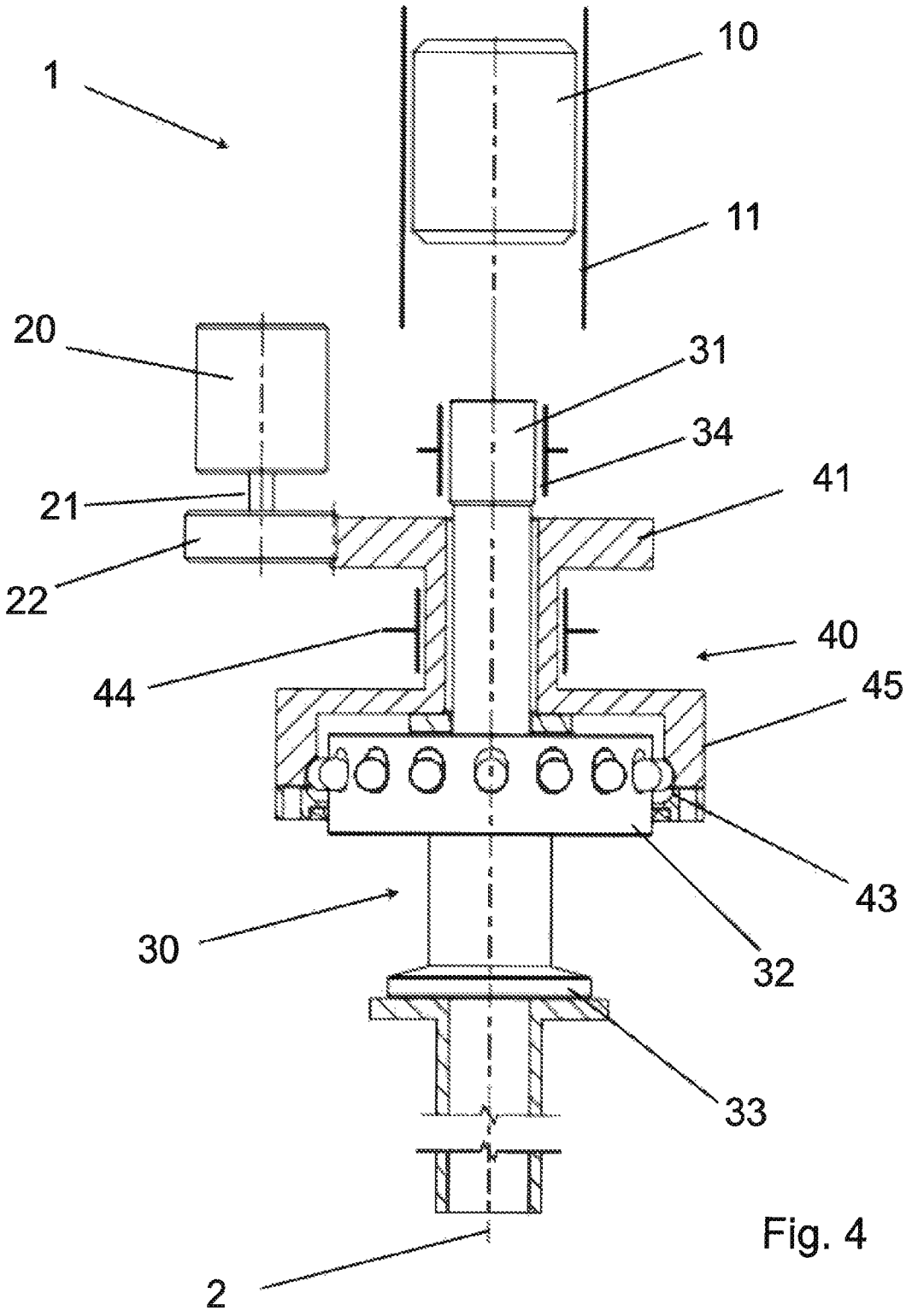
FIG. 4 a sectional illustration of a driving device according to the invention together with a bearing arrangement FIG. 5 a first embodiment of rolling bodies according to the invention FIG. 6 a second embodiment of rolling bodies according to the invention FIG. 7 a sectional illustration along a radial plane through a rolling-body pair FIG. 8 a third embodiment of rolling bodies according to the invention

Further to the illustration in FIG. 2, the insertion device 1, i.e. in particular the bearing arrangement of the hammer 10, the anchor 30 and the outer rotor 40, for example in a housing (not shown), are illustrated schematically in FIG. 4. The hammer 10 is mounted to be displaceable in the direction of the longitudinal axis 2 so that this relates to a linear guide 11. The hammer 10 is optionally secured against rotation. The anchor 30 is mounted in an anchor bearing 34 in the region of the anchor head 31. The anchor bearing 34 enables both a rotational movement of the anchor 30 about the longitudinal axis 2 and a translatory movement in the direction of the longitudinal axis 2. By way of example, this refers to a plain bearing bush. The outer rotor 40 is additionally mounted via a rotor bearing 44. Both the linear guide 11 and the anchor bearing 34 and the rotor bearing 44 are arranged in a housing (not shown). The rotor bearing 44 is formed as a radial bearing or pivot bearing. In conjunction with the bearing arrangement 50 between the anchor 30 and outer rotor 40, a defined bearing arrangement is provided during operation. During operation, the bearing arrangement 50 as shown in FIG. 4 is located in an end position other than when an impact is introduced as a result of the resistance created by the ground when driving in the screw foundation. In this case, the balls 52 are located on stops at the respective groove ends.

Figure 5:
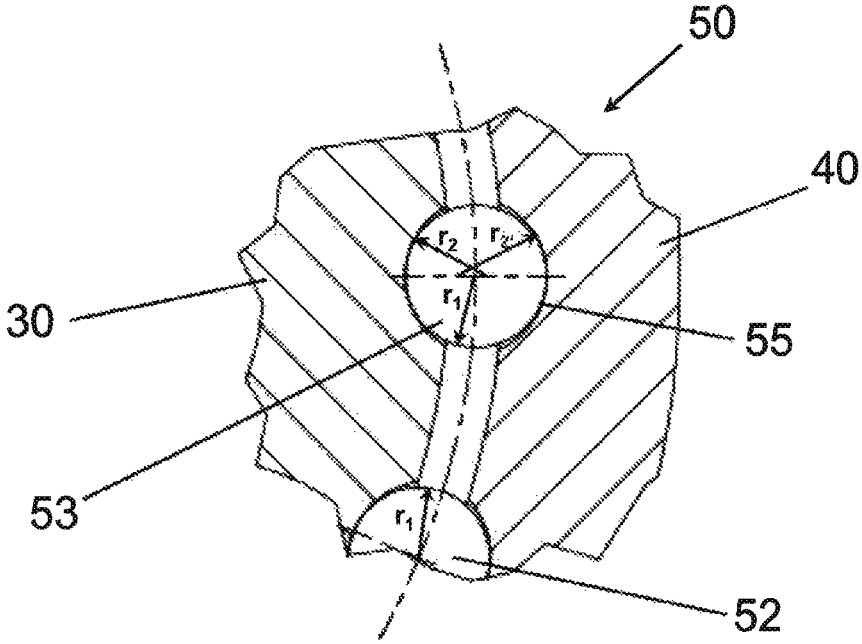
Figure 7:
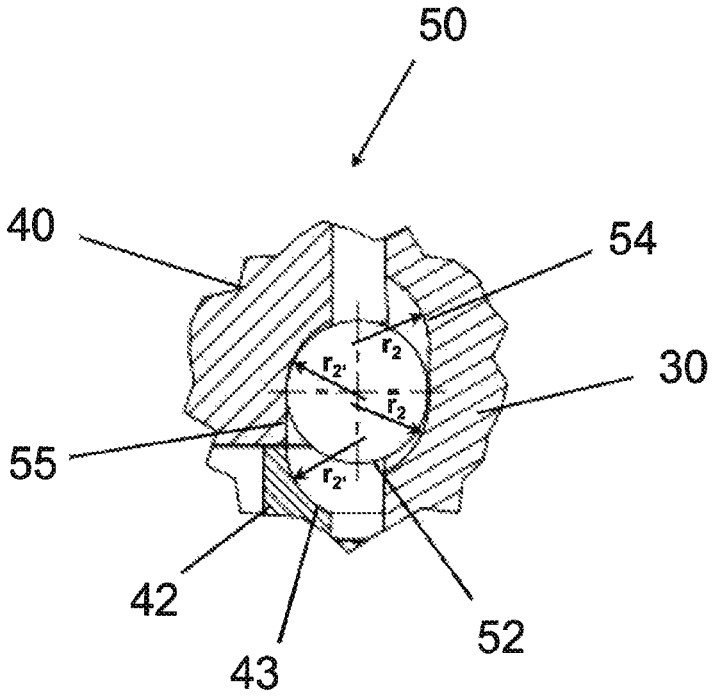

FIG. 5 shows a detail of the bearing arrangement 50. The anchor 30 and the outer rotor 40 shown in a section along the plane A-A. A radius $r_2$, $r_{2'}$ of the surface of the rotor grooves 54, 55 is greater than a radius $r_1$ of the balls 52. The radius $r_2$ of the rotor groove 55 corresponds to the radius $r_{2'}$ of the anchor groove 54 in the embodiment shown in the figure. The groove ends likewise have the radius $r_2$ or $r_{2'}$ in the longitudinal direction. The same applies to the radius of the circumferential chamfer 43 of the terminating ring 42, which is shown in FIG. 7. Under a load, i.e. during the transmission of a torque and the impact energy, the balls 52 are deformed so that the radius r1 in the region of the contact surface adapts to the surfaces with the radii $r_2$ or $r_{2'}$, i.e. the radius $r_1$ increases in these regions. As a result of the deformation of the balls 52 and the adaptation to the radius of the tracks in the grooves 54, 55, a surface pressure, the so-called Hertz surface pressure, is generated at the contact surfaces produced. As a result of the deformation of the balls 52, an ultimate surface pressure occurs which is therefore lower than a theoretical value for point contact without deformation.

A detail drawing with a section in the radial direction is shown in FIG. 7. In FIG. 7, the ball 52 is shown in an end stop. Therefore, the anchor 30 and the outer rotor 40 are likewise located in an end position relative to one another in the longitudinal direction. In this case, the ball is shown in an unloaded state, since the radius $r_1$ has not adapted to the radii $r_2$ or $r_{2'}$. As shown in FIG. 7, they have the same length so that, during the transfer from a first end stop into the opposing second end stop, the balls are moved in a rolling movement in both tracks and slip does not occur. As shown in FIG. 7, the bearing arrangement 50 is formed substantially without play in the radial direction to the longitudinal direction 2.

Figure 8:
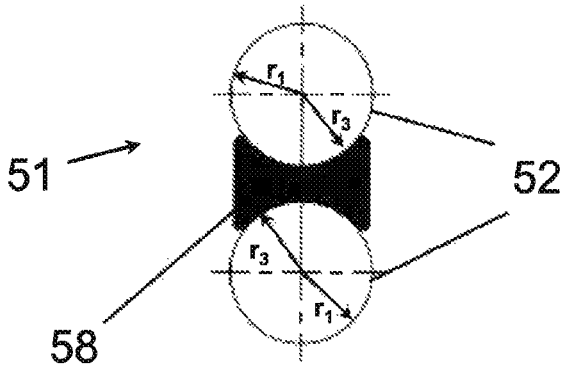

FIG. 8 shows an arrangement of two balls 52 which form the rolling bodies 51. In this case, the balls 52 are arranged spaced from one another by a cage 58. As a result of using two balls 52, the surface for transmitting a torque can be increased, whereby the Hertz surface pressure is reduced and a higher torque can be transmitted. At opposite ends, the cage 58 has recesses with a spherical surface. In this case, the radius of the spherical surface $r_3$ corresponds to the radius $r_1$ of the balls 52. The cage is formed from a resistant material, in particular metal, to enable the impact energy to be transmitted without damage, in particular to the spherical surface, and without plastic deformation.

Figure 6:
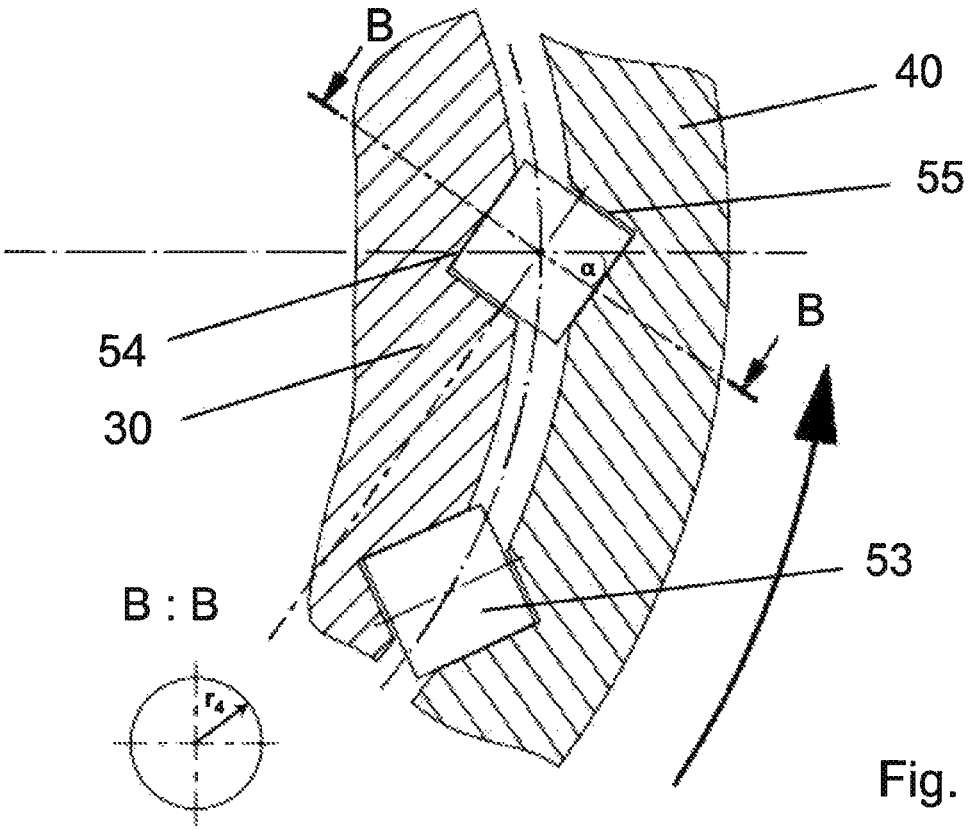

FIG. 6 shows an alternative embodiment, in which the rolling bodies 51 are formed as rollers 53. As revealed by the section along the plane B-B, the rollers 53 are cylindrically formed. To transmit a torque which is introduced to the outer rotor 40 in the direction of the arrow, the rollers 53 are pivoted through the angle $\alpha$ with respect to the radial direction. The torque is thus transmitted via the running surfaces of the rollers 53 and the correspondingly formed grooves 54, 55 and not via the side walls of the rollers 53 or the grooves 54, 55. In this case, as shown in FIG. 6, the grooves 54, 55 have a triangular cross-section. The rollers 53 have a radius $r_4$. The ends of the grooves 54, 55 which form the stop for the relative movement of the anchor 30 and rotor 40 with respect to one another have a radius $r_5$ (not shown), which is greater than the radius $r_4$. In this case, the form is analogous to the form of the balls 52 in FIG. 7. In this case, the direction of the arrow in FIG. 6 represents the driving direction. During the removal operation, the torque is transmitted via side walls of the rollers 53 so that static and dynamic friction is generated here. Therefore, compared to the rolling friction in the driving direction, a lower torque can be transmitted without thereby damaging the surfaces of the grooves 54, 55 and the rollers 53. Rollers 53 are therefore advantageous in that, in one direction, the torque which can be transmitted is greater than when using balls, although the torques which can be transmitted are direction-dependent.

The invention claimed is:

1. A driving device, having an anchor with a rotational axis for receiving a driving tool, an outer rotor, which is arranged concentrically to the rotational axis of the anchor and can be rotationally driven by a motor, an impact device from which an impact energy can be introduced into the anchor, characterized in that, by means of rolling bodies arranged circumferentially on the anchor, the anchor is mounted in the outer rotor in such a way that a relative movement between the anchor and the outer rotor can be executed in the direction of the rotational axis and a torque about the rotational axis can be introduced from the outer rotor to the anchor via the rolling bodies.

2. The driving device according to claim 1, characterized in that the rolling bodies are arranged in a plurality of grooves both in the outer rotor and in the anchor.

3. The driving device according to claim 2, characterized in that at least two rolling bodies are arranged in each of the grooves, which rolling bodies are separated from one another by a rolling bearing cage.

4. The driving device according to claim 2, characterized in that the grooves extend in a longitudinal direction parallel to the rotational axis.

5. The driving device according to claim 2, characterized in that the grooves are arranged on a slant and a first direction component extends in the longitudinal direction parallel to the rotational axis and a second direction component extends in the circumferential direction.

6. The driving device according to claim 2, characterized in that the grooves in the outer rotor are delimited by a terminating ring at an end facing the driving tool.

7. The driving device according to claim 6, characterized in that the terminating ring has a circumferential chamfer with a circular cross-sectional shape whereof the radius corresponds approximately to the radius of the rolling body.

8. The driving device according to claim 2, characterized in that the path available for the relative movement is delimited by the length of the grooves.

9. The driving device according to claim 1, characterized in that the rolling bodies are formed as balls.

10. The driving device according to claim 1, characterized in that the rolling bodies are formed as rollers.

11. The driving device according to claim 1, characterized in that a damping element is arranged between an axial shoulder in the anchor and an axial shoulder in the outer rotor.

12. The driving device according to claim 11, characterized in that the damping element is an elastomer, an oil damper or an air damper.

13. The driving device according to claim 1, characterized in that a seal is arranged between the anchor and the outer rotor.

14. The driving device according to claim 1, characterized in that the anchor has a driving tool holder for a screw foundation as a driving tool.

15. The driving device according to claim 1, characterized in that the driving device can be suspended on a carriage.

* * * * *